US011224984B2

(12) United States Patent
Chatzigrigoriou et al.

(10) Patent No.: US 11,224,984 B2
(45) Date of Patent: Jan. 18, 2022

(54) ADJUSTABLE SHAVER CARTRIDGES AND METHODS THEREOF

(71) Applicant: BIC VIOLEX S.A., Anoixi (GR)

(72) Inventors: Nikolaos Chatzigrigoriou, Attica (GR); Ioannis Psomiadis, Attica (GR)

(73) Assignee: BIC VIOLEX S.A., Anoixi (GR)

( * ) Notice: Subject to any disclaimer, the term of this patent is extended or adjusted under 35 U.S.C. 154(b) by 0 days.

(21) Appl. No.: 16/973,718

(22) PCT Filed: Jul. 31, 2019

(86) PCT No.: PCT/EP2019/070663

§ 371 (c)(1),
(2) Date: Dec. 9, 2020

(87) PCT Pub. No.: WO2020/025692

PCT Pub. Date: Feb. 6, 2020

(65) Prior Publication Data

US 2021/0245379 A1 Aug. 12, 2021

Related U.S. Application Data

(60) Provisional application No. 62/712,492, filed on Jul. 31, 2018.

(51) Int. Cl.
*B26B 21/40* (2006.01)
*B26B 21/52* (2006.01)

(52) U.S. Cl.
CPC ..... *B26B 21/4056* (2013.01); *B26B 21/52* (2013.01)

(58) Field of Classification Search
CPC ..... B26B 21/456; B26B 21/52
See application file for complete search history.

(56) References Cited

U.S. PATENT DOCUMENTS 6,009,623 A 1/2000 Orloff
6,295,734 B1 10/2001 Gilder et al.
9,844,887 B2 12/2017 Griffin et al.
(Continued)

FOREIGN PATENT DOCUMENTS

DE 102006004675 A1 8/2007
WO 2013111139 A1 8/2013

OTHER PUBLICATIONS

International Search Report and Written Opinion in International Application No. PCT/EP2019/070663, dated Nov. 19, 2019 (12 pages).

*Primary Examiner* — Omar Flores Sanchez
(74) *Attorney, Agent, or Firm* — Bookoff McAndrews, PLLC

(57) ABSTRACT

A shaving system has a shaver having a handle, a razor cartridge including at least one blade, at least one sensor associated with the at least one blade and configured to detect a pressure applied to the at least one blade, and at least one resilient element associated with the at least one blade. The at least one resilient element is configured to deform in response to the pressure applied to the at least one blade and/or the at least one resilient element has an adjustable modulus of elasticity. The shaving system further including a processor operably coupled to the at least one resilient element; and a controller operably coupled to the processor that is configured to generate a signal to adjust the modulus of elasticity of the at least one resilient element.

9 Claims, 3 Drawing Sheets

(56) References Cited

U.S. PATENT DOCUMENTS

| | | | | |
|---|---|---|---|---|
| 2011/0314677 | A1* | 12/2011 | Meier | A46B 13/02 30/41.8 |
| 2012/0260509 | A1* | 10/2012 | Fang | B26B 21/52 30/527 |
| 2013/0070953 | A1* | 3/2013 | Dodd | B26B 21/528 381/398 |
| 2014/0137883 | A1 | 5/2014 | Rothschild | |
| 2016/0046028 | A1* | 2/2016 | Meier | B26B 21/4056 30/41 |
| 2017/0099199 | A1 | 4/2017 | Bauer et al. | |

* cited by examiner

ADJUSTABLE SHAVER CARTRIDGES AND METHODS THEREOF

CROSS REFERENCE TO RELATED APPLICATIONS

This application is a National Stage Application of International Application No. PCT/EP2019/070663, filed on Jul. 31, 2019, now published as WO/2020/025692 and which claims priority to U.S. patent application 62/712,492 filed on Jul. 31, 2018, entitled "ADJUSTABLE SHAVER CARTRIDGES AND METHODS THEREOF".

TECHNICAL FIELD

Aspects of the present disclosure relate generally to shaving technology, and, specifically, to embodiments of shavers having adjustable resilient elements stiffness.

DESCRIPTION OF RELATED TECHNOLOGY

Shavers generally include a handle and a razor cartridge attached to one end of the handle. The razor cartridge includes at least one blade for shaving hair. The user holds the handle and repeatedly moves the razor across an area of the body to be shaved, e.g., the face, until hair is removed from the surface of the body. Although shaving may be a routine part of many people's hygiene regimen, some people may not shave in an efficient manner. For example, some people may apply too little pressure when shaving and, as a consequence, may not achieve a close shave, which may in turn result in the user taking extra shaving strokes. Taking extra strokes may in turn result in increased shaving time, skin irritation, and/or shortened blade durability. Alternatively, some people may apply too much pressure when shaving, increasing the likelihood of nicks, cuts, and/or skin irritation, and/or shortening blade durability due to excessive force. Additionally, some people may apply inconsistent pressure when shaving, alternating between too much, too little, and adequate pressure, resulting in inefficient shaving. Embodiments of the present disclosure may address some of these issues, as well as others, creating a more efficient and enjoyable shaving experience for users.

Both the foregoing general description and the following detailed description are exemplary and explanatory only and are not restrictive of the features, as claimed. As used herein, the terms "stiffness" and "modulus of elasticity" are used interchangeably to mean the same thing. As used herein, the terms "comprises," "comprising," or other variations thereof, are intended to cover a non-exclusive inclusion such that a process, method, article, or apparatus that comprises a list of elements does not include only those elements, but may include other elements not expressly listed or inherent to such a process, method, article, or apparatus. Additionally, the term "exemplary" is used herein in the sense of "example," rather than "ideal." It should be noted that all numeric values disclosed or claimed herein (including all disclosed values, limits, and ranges) may have a variation of +/−10% (unless a different variation is specified) from the disclosed numeric value. Moreover, in the claims, values, limits, and/or ranges mean the value, limit, and/or range +/−10%.

BRIEF DESCRIPTION OF THE FIGURES

The accompanying drawings, which are incorporated in and constitute a part of this specification, illustrate the disclosed embodiments, and together with the description, serve to explain the principles of the disclosed embodiments. There are many aspects and embodiments described herein. Those of ordinary skill in the art will readily recognize that the features of a particular aspect or embodiment may be used in conjunction with the features of any or all of the other aspects or embodiments described in this disclosure. In the drawings.

DETAILED DESCRIPTION

Reference will now be made in detail to the exemplary embodiments of the present disclosure described below and illustrated in the accompanying drawings. Wherever possible, the same reference numbers will be used throughout the drawings to refer to same or like parts.

Additional objects and advantages of the embodiments will be set forth in part in the description that follows, and in part will be obvious from the description, or may be learned by practice of the embodiments. It is to be understood that both the foregoing general description and the following detailed description are exemplary and explanatory only and are not restrictive of the claims.

Embodiments of the present disclosure include systems and methods to facilitate and promote efficient shaving techniques and/or an improved shaving experience. For example, aspects of the present disclosure may include one or more sensors embedded within, placed on a surface of, or otherwise operably coupled to one or more of the razor cartridge, the blade of a shaver, and/or the handle. The sensors may detect how much pressure is being applied to the user's skin during shaving, and the sensed pressure data may be used to adjust the stiffness of the resilient elements that allow the shaver blade to move and contour to the user's skin. Accordingly, the shaver may adjust to the user's shaving strokes by altering the stiffness of internal parts (e.g., resilient elements like springs or spring fingers coupled to the blades) in order to maintain a constant pressure of the shaver against the user's skin, providing a consistent, safe, and efficient shave.

Figure 1:
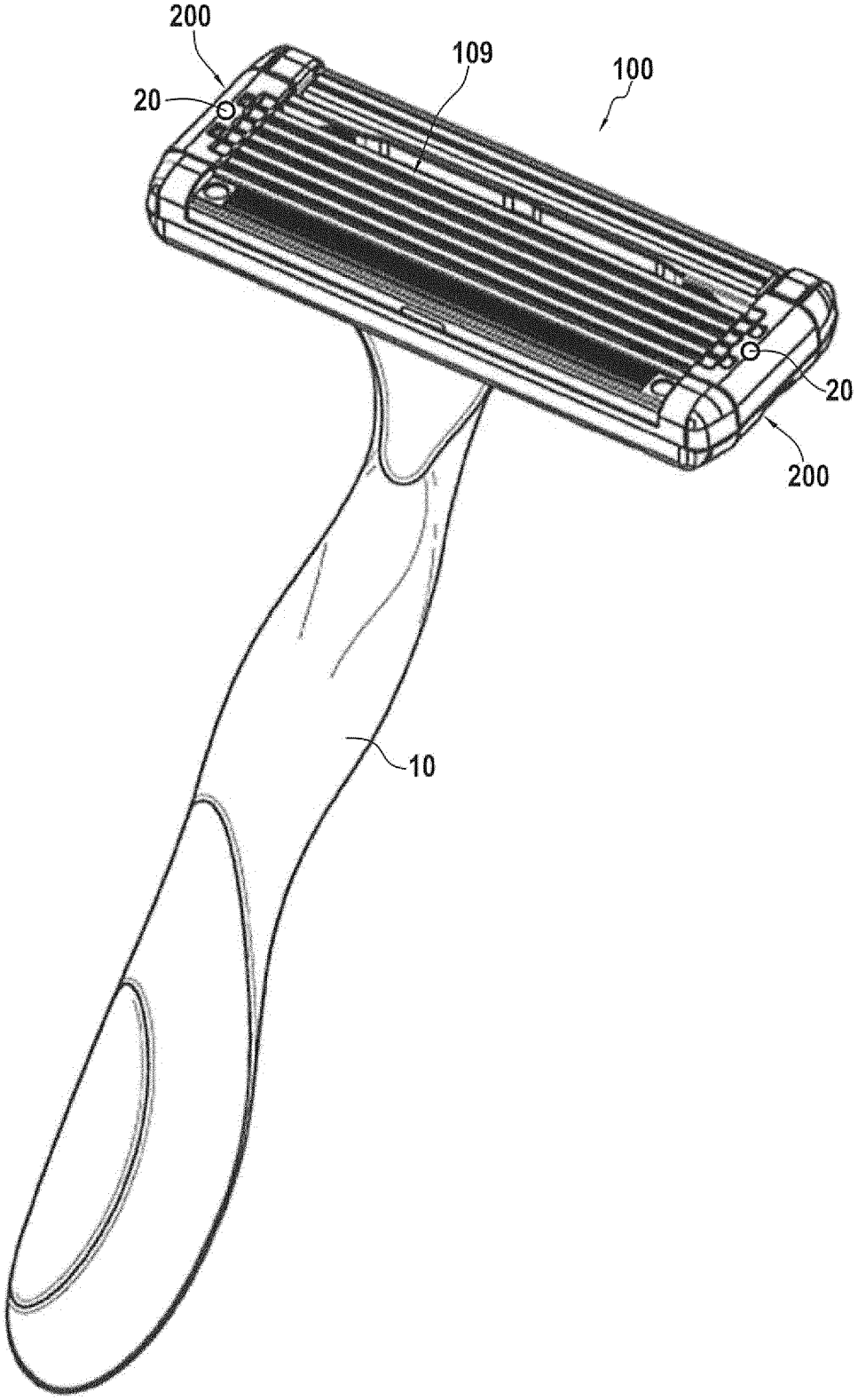
FIG. 1 depicts an exemplary shaving device, according to various embodiments of the present disclosure.

FIG. 1 portrays an exemplary shaver 100. Shaver 100 includes a handle 10 and a razor cartridge 200 having at least one blade 109. Razor cartridge 200 may be releasably secured to handle 10. In some embodiments, razor cartridge 200 may not detach from handle 10, and razor cartridge 200 may not be disposable.

Shaver 100 may also include one or more sensors 20 configured to determine how much pressure a user is applying to his/her skin during use. For example, sensors 20 may include one or more piezoelectric or piezoresistive pressure sensors or transducers. Sensors 20 may be located on one or more blades 109, on a surface of razor cartridge 200 configured to support one or more blades 109, on a surface of razor cartridge 200 configured to contact the skin of a user during a shaving event, at a base of razor cartridge 200 (e.g., where razor cartridge 200 connects to handle 10), and/or on a distal region of the handle in line with razor cartridge 200 (when connected), or a combination of locations.

Figure 2:
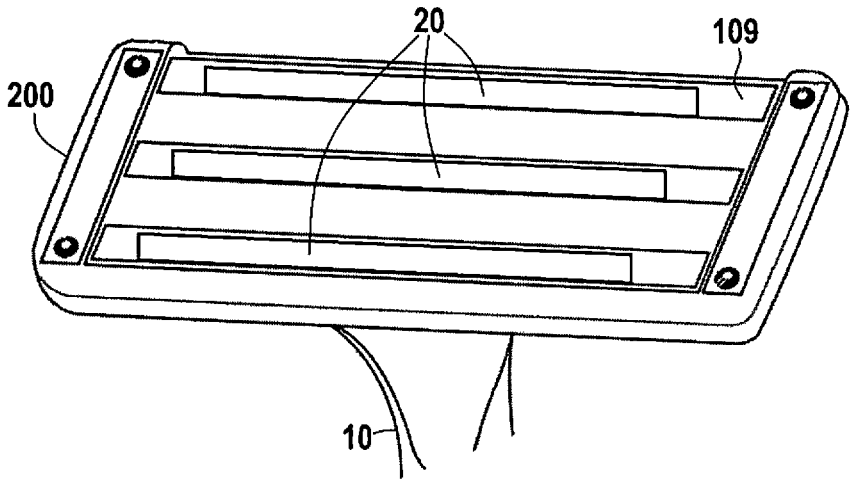
FIG. 2 depicts a portion of an exemplary shaving device, according to various embodiments of the present disclosure.

For example, sensor 20 may be a thin-film pressure sensor that extends along at least a portion of blade 109 configured to contact a user's skin, as is shown in FIG. 2. In some aspects, sensor 20 may be located where blade 109 contacts or otherwise connects with razor cartridge 200 so that sensor 20 detects any force applied to blade 109 as blade 109 is pushed against the skin and thereby compresses against razor cartridge 200. In some aspects, sensor 20 may be located separate from blade 109, e.g., on a region of razor cartridge 200 that contacts the skin (as is shown in FIG. 1), or on a region of razor cartridge 200 to which pressure applied to blades 109 would be transmitted during shaving, e.g., a center region of razor cartridge 200 or a region where razor cartridge 200 contacts or is otherwise connected to handle 10. In some embodiments, sensor 20 may be located on a region of handle 10 where razor cartridge 200 meets handle 10, so that pressure transferred from razor cartridge 200 to handle 10 is measured by one or more sensors 20. It is contemplated that one sensor 20 or a plurality of sensors 20 may be located in any suitable location or combination of locations on shaver 100.

Figure 3:
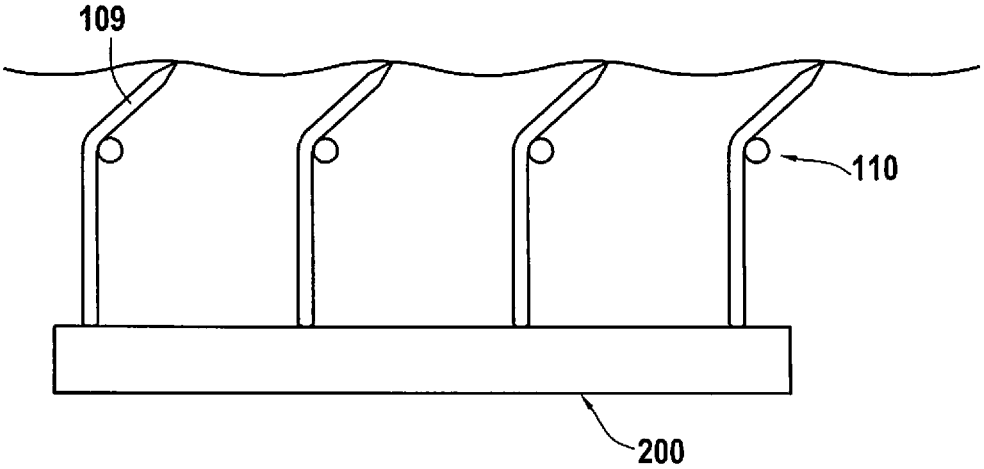
FIG. 3 depicts an exemplary resilient element configuration, according to various embodiments of the present disclosure.

Shaver 100 may further include one or more resilient elements 110. Resilient elements 110 may include one or more springs, spring fingers, or similar structures. Resilient elements 110 may be located adjacent blades 109 and/or may support blades 109, so that blades 109 may depress against resilient elements 110 in response to pressure applied by a user as the user shaves. In some aspects, resilient elements 110 may be located at a base of razor cartridge 200 and may affect the flexing of the entire razor cartridge 200 as the user shaves. In FIG. 3, a plurality of resilient elements 110 are depicted adjacent a plurality of blades 109 where the end region of each blade 109 is supported by razor cartridge 200. It is contemplated that one or more resilient elements 110 may be associated with each blade 109, as is shown in FIG. 3, or one or more resilient elements 110 may be associated with a single blade 109 or a subset of blades 109.

Resilient elements 110 may have a selectively variable stiffness. The stiffness of resilient elements 110 may be adjusted by altering the modulus of elasticity of the material that forms the resilient elements. For example, resilient elements 110 may be formed of a material that changes in stiffness in response to stimuli, such as electrical current or heat. In some aspects, resilient elements 110 may be formed of an electro-responsive plastic, e.g., intrinsically conductive polymers, and/or shape-memory metals, e.g., nitinol. Stiffness of resilient elements 110 may be modulated by altering the current that passes through resilient elements 110 or by using current and resistance to locally increase the temperature of resilient elements 110. In some aspects, the modulus of elasticity of resilient elements 110 may be adjusted by altering the shape and/or dimensions of resilient elements 110. For example, the width and/or thickness of resilient elements 110 may be altered, e.g., to form a narrower or wider coil and/or a tighter or looser coil in response to current and/or temperature. In some aspects, the length, height, width, and/or thickness of resilient elements 110 may be altered in response to current and/or temperature, and/or a shape and/or angle of resilient elements 110 may be altered in response to current and/or temperature. For example, a leaf spring resilient element 110 may increase or decrease in degree of curvature in response to changes in current and/or temperature. In some aspects, properties of the metal or polymer from which resilient elements 110 are formed may change, thus altering how readily resilient elements 110 deform in response to pressure.

Resilient elements 110 may be configured so that they become relatively harder/stiffer as less pressure is applied by the user and become relatively softer/less stiff as more pressure is applied by the user during shaving. This increase or decrease in the modulus of elasticity of resilient elements 110 may help the user to achieve a more constant shaving pressure, may maintain blades 109 at a more consistent spacing relative to the user's skin, and may achieve a more even shave, may decrease irritation, may decrease the likelihood of nicks and cuts, and may prolong the life of blades 109. As one or more sensors 20 detect changes in the amount of pressure being applied to blades 109 and/or razor cartridge 200 during shaving, resilient elements 110 may increase or decrease in elasticity to account for the pressure changes, e.g., in real-time during a shaving session. As the stiffness of resilient elements 110 changes in response to pressure, blades 109 of razor cartridge 200 may depress more or less easily as the user shaves. If resilient elements 110 are located at a proximal region of razor cartridge 200, then as the stiffness of resilient elements 110 changes in response to pressure, razor cartridge 200 may flex more or less easily as the user shaves.

Shaver 100 may further include a processor configured to receive information from sensors 20 and to determine whether the modulus of elasticity of resilient elements 110 should be altered and, if so, by how much. Shaver 100 may also include a controller operably coupled to the processor and configured to alter the amount of current and/or heat passing to resilient elements 110 to adjust the stiffness of resilient elements 110, if necessary, as determined by the processor. The processor and/or controller may be located in the cartridge 200, in handle 10, or externally to shaver 100, as explained in greater detail below. One or more sensors 20 may be operably coupled to a processor, and pressure data detected by sensors 20 may be stored in a memory and/or analyzed by a processor to determine how much pressure is being applied by a user to blades 109, how resilient elements 110 should be modified to account for that pressure, if at all, and how much current and/or heat should be generated in order to achieve the desired change in the modulus of elasticity and/or deformation of resilient elements 110 and/or to deform resilient elements 110 in response to the pressure applied by blades 109. For example, the processor may have software and/or one or more algorithms stored thereon that are configured to receive and analyze raw sensor data. Deformation of resilient elements 110 in response to pressure applied by blades 109 may be adjustable in response to an electrical current and/or an increase in temperature.

The processor, controller, and/or memory may be housed in shaver 100 (e.g., within handle 10). Circuitry and/or wires may operably couple sensors 20 to the processor, which may also be operably connected to the controller, which may be operably connected to circuitry and/or wires associated with resilient elements 110. In some aspects, the processor, controller, and/or the memory may be included in a smartphone or computer, and the processor may be equipped with software configured to analyze data from sensors 20 to determine how much pressure is being applied by the user, whether resilient elements 110 should be adjusted to offset this amount of pressure, and, if so, how resilient elements 110 should be adjusted (e.g., how much current should be generated in order to change the modulus of elasticity of resilient elements 110 by the desired amount). For example, shaver 100 may be operably coupled (e.g., via Bluetooth or wireless internet) to a smartphone or computer, and data may be transmitted between the devices. For example, data from sensors 20 may be transmitted to a processor, and a controller may generate a signal to adjust the amount of current and/or heat produced by electronic components located in shaver 100 to modify the stiffness of resilient elements 110.

In some aspects, the processor, controller, and/or memory may be located on a separate base located apart from shaver 100 during use but configured to receive shaver 100 for storage. For example, shaver 100 may be configured to mount on a base when not in use or when charging (for rechargeable, electronic shavers 100). In some embodiments, a separate base may be configured so that the user can attach or sit the base on, e.g., a shelf, sink, cabinet, mirror, or any suitable surface. A processor, controller, and/or memory may be incorporated into the base, and the processor may be equipped with software configured to analyze data from sensors 20 to determine how much pressure is being applied by the user, whether resilient elements 110 should be adjusted to offset this amount of pressure, and, if so, how resilient elements 110 should be adjusted (e.g., how much current should be generated in order to change the modulus of elasticity of resilient elements 110 by the desired amount). Shaver 100 may be operably coupled (e.g., via Bluetooth or wireless internet) to the base, and data may be transmitted between the devices. For example, data from sensors 20 may be transmitted to a processor, and a controller may generate a signal to adjust the amount of current and/or heat produced by electronic components located in shaver 100 to modify the stiffness of resilient elements 110.

The processor on one or more of a base, a smartphone, a computer, and/or shaver 100 may continuously (e.g., in real time) or intermittently receive information from sensors 20 and may continuously (e.g., in real time) or intermittently analyze the pressure data. The controller may continuously or intermittently output signals to shaver 100 to adjust resilient elements 110 to accommodate the pressure being applied by a user during a shaving event, as determined by the processor. It is also contemplated that multiple processors, controllers, and/or memories in multiple locations may be used and may communicate with one another. For example, shaver 100 may include a processor, controller, and/or memory, which may also be operably connected to a processor, controller, and/or memory on a computer, smartphone, and/or base, which e.g., may store and/or analyze pressure data and/or historical shaving data for the user. In some aspects, a memory, controller, and/or processor in shaver 100 may communicate with a memory, controller, and/or processor in the base when shaver 100 is mounted on the base after use, e.g., to reset resilient elements 110 to an initial, starting modulus of elasticity. For example, in some aspects, a user may historically use a certain amount of pressure when initiating a shaving event, so resilient elements 110, the processor, and/or the controller may return to that initial setting once a shaving event is complete.

Figure 4:
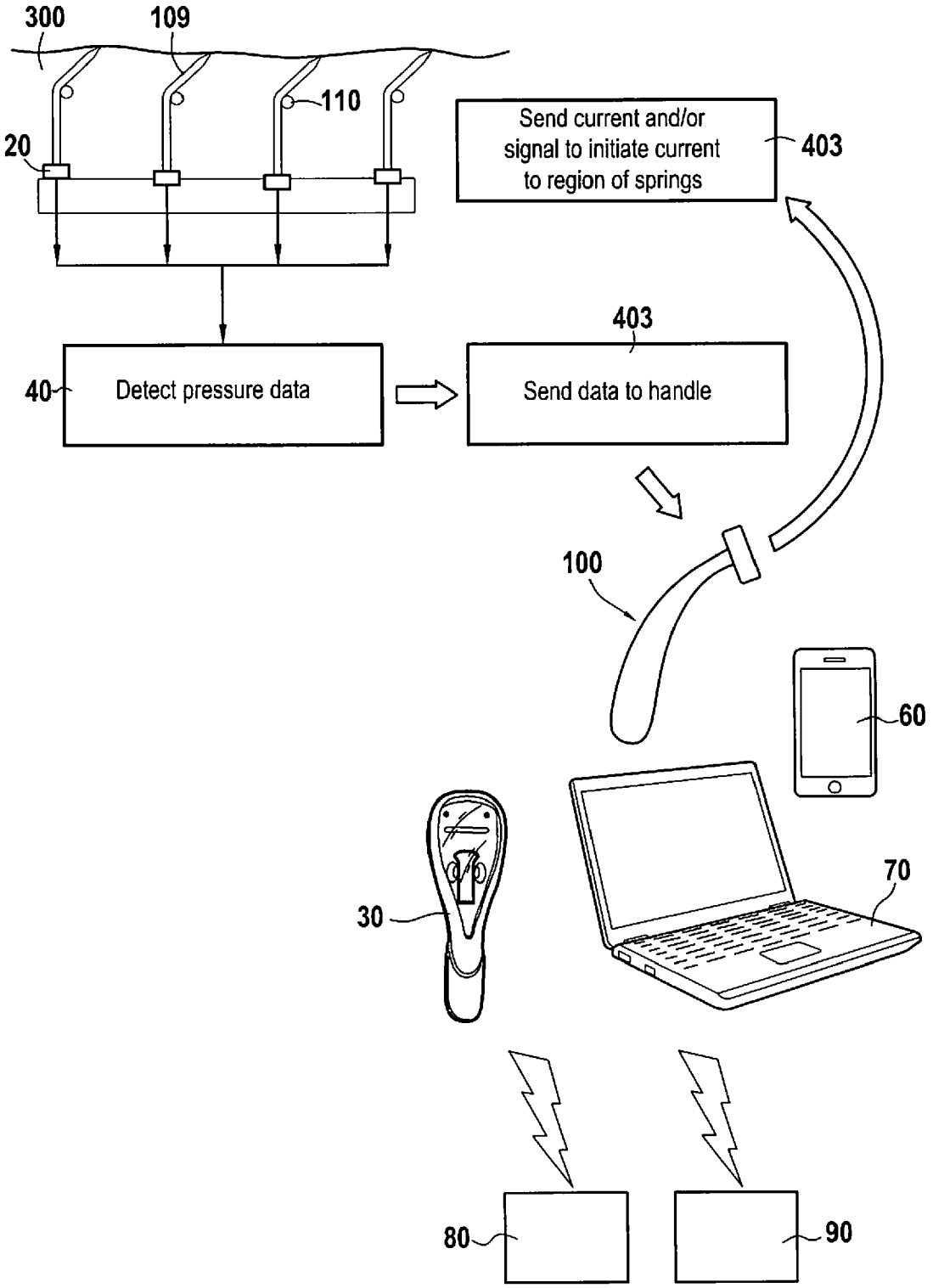
FIG. 4 is a pictorial flow chart portraying an exemplary shaving method, according to various embodiments of the present disclosure.

During a shaving event, shaver 100 may be pressed against the surface of a user's skin in order to cut body hair. As shaver 100 is moved across skin 300, sensors 20 may detect how much pressure is being applied to shaver 100 against skin 300 (step 40 in FIG. 4). Sensors 20 may be configured to continuously collect pressure information or may intermittently take pressure readings as the user shaves. As is shown in FIG. 4, the pressure data may be sent to a processor 80, controller 90, and/or a memory, which may be associated with shaver 100 or a separate smartphone 60, computer 70, and/or base 30 (step 403). Processor 80 associated with shaver 100, separate smartphone 60, computer 70, and/or base 30, may itself analyze or may be equipped with software configured to analyze the pressure data received from sensors 20 to determine how much pressure is being applied by the user's skin, whether resilient elements 110 should be adjusted to offset this amount of pressure, and, if so, how resilient elements 110 should be adjusted (e.g., how much current should be generated in order to change the modulus of elasticity of resilient elements 110 by the desired amount).

If processor 80 determines that resilient elements 110 should be modified in order to accommodate a change in pressure detected by sensors 20, then processor 80 may communicate that information to controller 90, which may generate a signal to initiate a current change in shaver 100, for example. This signal may be sent via hard wire (e.g., if processor 80 and/or controller 80 is located in handle 10) or may be sent wirelessly (e.g., via WiFi or Bluetooth). The current change may be adjusted in response to the received signal from controller 90, and, as a result, one or more resilient elements 110 may change in terms of shape, dimension, and/or other property of the material from which resilient elements 110 are formed, producing a change in the stiffness of one or more resilient elements 110. Accordingly, as a user shaves, pressure data may be transmitted to processor 80, which may transmit information to controller 90, which may adjust resilient elements 110 to accommodate the amount of pressure the user applies to his/her skin with shaver 100 so that the user achieves a more uniform shave in real time.

In some aspects, each blade 109 may have multiple different resilient elements 110 associated with it, and individual resilient elements 110 or subsets of resilient elements 110 may have a stiffness that can be individually controlled, as explained herein. For example, when shaving uneven body surfaces, more or less pressure may be applied to one region of the same blade compared to other regions of that blade. Or, a user may apply more pressure to one side of a razor cartridge 200, and thus, more pressure to one end of blade 109, than the other. Sensors 20 associated with the different regions of blade 109 may detect different pressures, and shaver 100 may be configured to deliver different amounts of heat and/or current to different resilient elements 110 depending on how much pressure is being applied to the different resilient elements 110. As a result, the stiffness of one resilient elements 110 may be adjusted differently relative to the stiffness of another resilient elements 110. Such a configuration may assist in correcting issues associated with a user's grip of handle 10 and/or orientation of cartridge 200 relative to the skin being shaved.

In some aspects, resilient elements 110 associated with different blades 109 may be individually controlled, as explained herein. For example, a user may apply more or less pressure to a leading region or a trailing region of razor cartridge 200, and thus different blades 109. Accordingly, sensors 20 associated with different blades 109 may detect different pressures, and shaver 100 may be configured to deliver different amounts of heat and/or current to different resilient elements 110 depending on how much pressure is being applied to the different resilient elements 110 associated with different blades.

In some embodiments, the user may also be able to calibrate the amount by which the elasticity of resilient elements 110 are adjusted. For example, if shaver 100 is operably coupled to a smartphone or computer, the user may use an application to input the type of shave he/she desires, or may indicate the shaving level of the user and/or body location to be shaved. For example, if a user desires stubble as opposed to a clean shave, the user may want an overall lesser degree of stiffness in resilient elements 110 so that blades 109 more readily depress into resilient elements 110 when pressed against the skin of the user. Or, a beginner user or a user with physical limitations may desire an overall lesser degree of stiffness in resilient elements 110 so that blades 109 more readily depress into resilient elements 110 when pressed against the skin of the user in order to decrease the chances of the user cutting or nicking the skin. Accordingly, while resilient elements 110 may still adjust in response to the amount of pressure applied, the adjustments may be calibrated to accommodate the user's preference. In some aspects, the user also may be able to turn off the automatic adjustment of resilient elements 110.

All technical and scientific terms used herein have the same meaning as commonly understood to one of ordinary skill in the art to which this disclosure belongs unless clearly indicated otherwise. As used herein the singular forms "a", "an", and "the" include plural references unless the context clearly dictates otherwise. Thus, for example, reference to "a sensor" may include a plurality of such sensors and reference to "the sensor" may include reference to one or more sensors and equivalents thereof known to those skilled in the art, and so forth.

The many features and advantages of the present disclosure are apparent from the detailed specification, and thus, it is intended by the appended claims to cover all such features and advantages of the present disclosure that fall within the true spirit and scope of the disclosure. Further, since numerous modifications and variations will readily occur to those skilled in the art, it is not desired to limit the present disclosure to the exact construction and operation illustrated and described, and accordingly, all suitable modifications and equivalents may be resorted to, falling within the scope of the present disclosure.

What is claimed is:

1. A shaving system, comprising:

a shaver having a handle, a razor cartridge including at least one blade, at least one sensor associated with the at least one blade and configured to detect a pressure applied to the at least one blade, and at least one resilient element associated with the at least one blade, wherein the at least one resilient element is configured to deform in response to the pressure applied to the at least one blade and/or the at least one resilient element has an adjustable modulus of elasticity;

a processor operably coupled to the at least one resilient element and configured to receive a pressure data from the at least one sensor; and a controller operably coupled to the processor, wherein the controller is configured to generate a signal to adjust the modulus of elasticity of the at least one resilient element based at least in part on the pressure data received by the processor and/or to deform the at least one resilient element in response to the pressure applied by the at least one blade.

2. The shaving system of claim 1, wherein at least one of the processor or the controller is located in the handle.

3. The shaving system of claim 1, comprising a plurality of blades and a plurality of resilient elements, wherein at least one resilient element of the plurality of resilient elements is associated with each of the plurality of blades.

4. The shaving system of claim 3, further comprising a plurality of sensors, wherein at least one sensor of the plurality of sensors is associated with each of the plurality of blades.

5. The shaving system of claim 1, wherein the modulus of elasticity of the at least one resilient element is further adjustable in response to an electrical current and/or an increase in temperature.

6. The shaving system of claim 1, wherein deformation of the at least one resilient element in response to the pressure applied by the at least one blade is further adjustable in response to an electrical current and/or an increase in temperature.

7. The shaving system of claim 4, wherein the modulus of elasticity of the at least one resilient element is adjusted to a modulus of elasticity that is different from another resilient element.

8. The shaving system of claim 1, wherein the shaver is operatively coupled to a user interface.

9. The shaving system of claim 8, wherein the controller is configured to calibrate the modulus of elasticity of the at least one resilient element based on a user's input into the user interface.

* * * * *